United States Patent [19]

Spitaler et al.

[11] Patent Number: 4,664,406

[45] Date of Patent: May 12, 1987

[54] HEEL HOLDER

[75] Inventors: Engelbert Spitaler, Neudorf; Henry Freisinger, Wien, both of Austria

[73] Assignee: TMC Corporation, Baar, Switzerland

[21] Appl. No.: 700,260

[22] Filed: Feb. 11, 1985

[30] Foreign Application Priority Data

Feb. 10, 1984 [AT] Austria ..... 424/84
Mar. 6, 1984 [AT] Austria ..... 747/84

[51] Int. Cl.[4] ..... A63C 9/084
[52] U.S. Cl. ..... 280/632; 280/634
[58] Field of Search ..... 280/631, 632, 628, 626, 280/634

[56] References Cited

U.S. PATENT DOCUMENTS

| | | | |
|---|---|---|---|
| 3,580,597 | 5/1971 | Beyl | 280/632 |
| 4,111,453 | 9/1978 | Krob | 280/626 |
| 4,457,534 | 7/1984 | Richert | 280/631 |
| 4,494,767 | 1/1985 | Campillo et al. | 280/632 |

FOREIGN PATENT DOCUMENTS

| | | | |
|---|---|---|---|
| 296839 | 6/1971 | Austria | 280/632 |
| 3033021 | 4/1982 | Fed. Rep. of Germany | 280/632 |
| 3105294 | 9/1982 | Fed. Rep. of Germany | 280/632 |

*Primary Examiner*—John J. Love
*Assistant Examiner*—Eric D. Culbreth
*Attorney, Agent, or Firm*—Flynn, Thiel, Boutell & Tanis

[57] ABSTRACT

A heel holder has a bearing block on which a binding housing biased by an opening spring and a control lever biased by an adjustable locking spring are supported for movement about two transverse axles. A control member is associated with the control lever and, in the downhill skiing position of the heel holder, is held by a release lever. In one preferred embodiment, the control member is a crankshaft which is rotated during a voluntary release. In a second preferred embodiment, the release lever is supported on the bearing block on the axle of the binding housing, and it has two legs which carry hook-shaped projections and are arranged within the sidewalls of the bearing block.

7 Claims, 9 Drawing Figures

HEEL HOLDER

FIELD OF THE INVENTION

The invention relates to a heel holder and, in particular, to a heel holder which includes a bearing block, a binding housing pivotally supported on the bearing block by a first transverse axle, biased by an opening spring and having at its end which faces a ski shoe a down-holding member and a stepping spur, a control lever pivotally supported on the bearing block by a second transverse axle and biased by a locking spring which can be adjusted in its initial tension, the two transverse axles being spaced from one another in the longitudinal direction of the ski, and a control member which is associated with the side of the control lever facing the ski shoe and is held, in the downhill skiing position of the heel holder, by a release lever.

BACKGROUND OF THE INVENTION

Such a heel holder is described in U.S. Pat. No. 4,111,453. In the known embodiment, the control member is a bolt which is guided in circular guideways of the bearing block, in downwardly open circular slots of the housing, and in angled guide slots of a slide member. This construction has the disadvantage that, at the start of a voluntary release, a relatively large friction between the control member and the release lever exists, especially since the control member is biased by the full pressure of the locking spring. Furthermore, the design of this known heel holder is relatively complicated.

The invention has as one purpose to overcome these disadvantages and to provide a heel holder of the above-mentioned type, in which the effort required for a voluntary release is substantially reduced.

SUMMARY OF THE INVENTION

This purpose is attained inventively by each of two different constructions. In a first inventive construction, the control member is a crankshaft which is supported in the region of the binding housing adjacent the base of the bearing block and below the control lever, and the crank thereof engages the control lever. In the other inventive construction, the control member is a control bolt, and the release lever is supported in the bearing block on the axle for the binding housing and has two legs which carry hook-shaped projections and are arranged within the sidewalls of the bearing block.

BRIEF DESCRIPTION OF THE DRAWINGS

The drawings illustrate three exemplary embodiments of the subject matter of the invention.

FIG. 6 is a view similar to FIG. 5 showing a further operational position which facilitates stepping-in;

DETAILED DESCRIPTION

Figure 1:
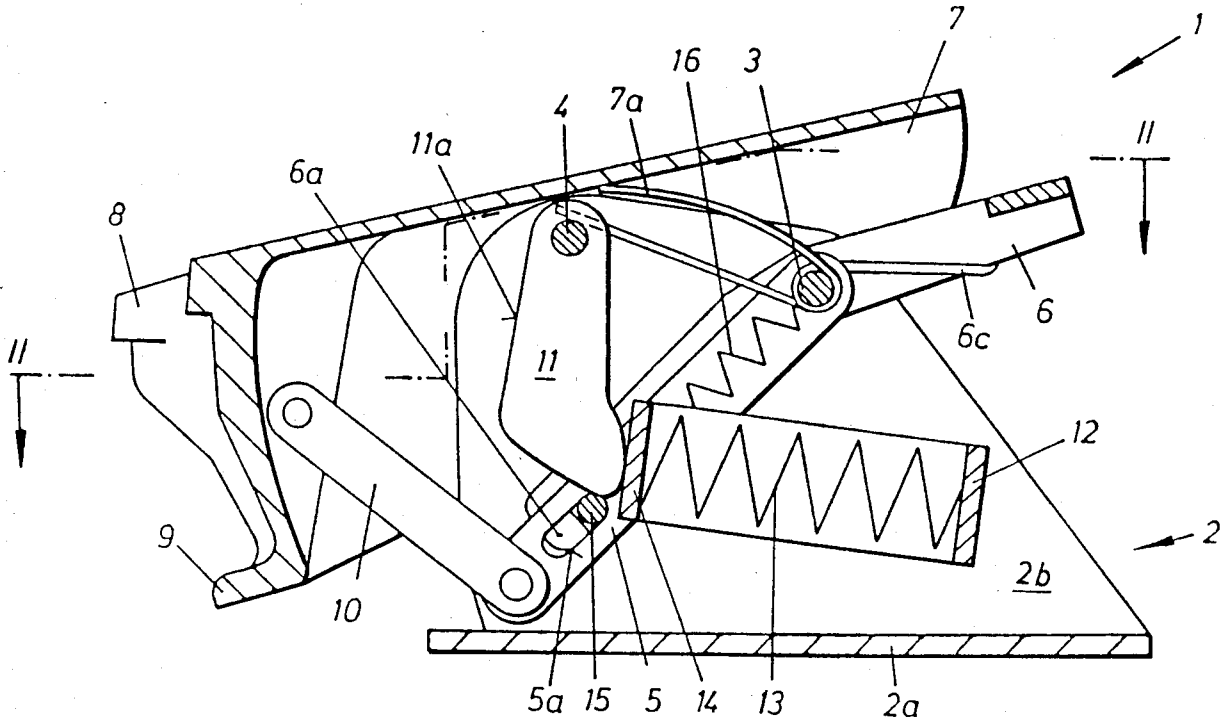
FIG. 1 is a sectional side view taken along the line I—I in FIG. 2 of a heel holder which embodies the invention and is in its downhill skiing position.
Figure 2:
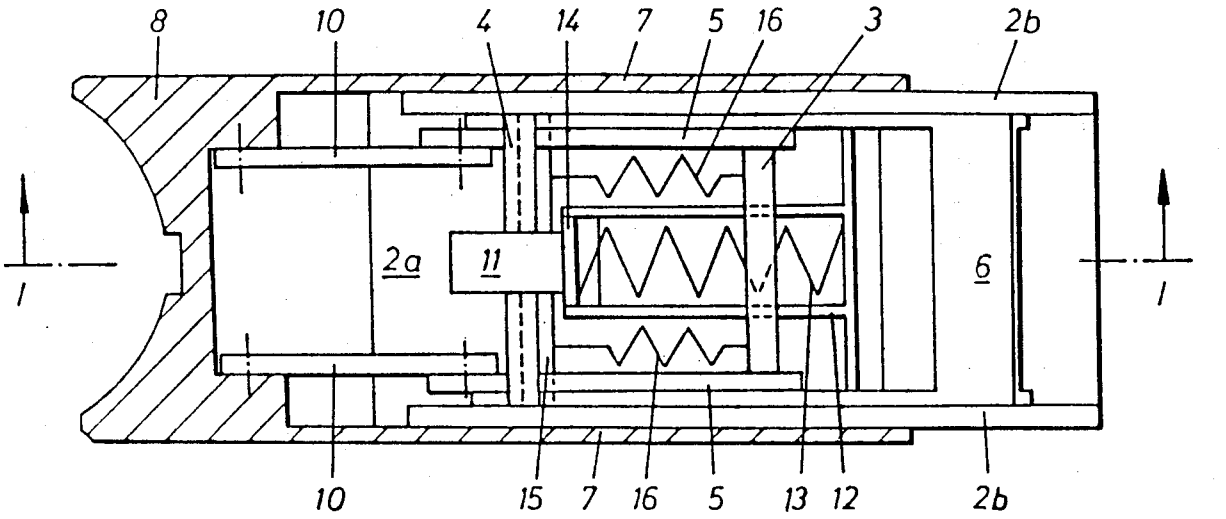
FIG. 2 is a sectional view taken along the line II—II in FIG. 1.
Figure 3:
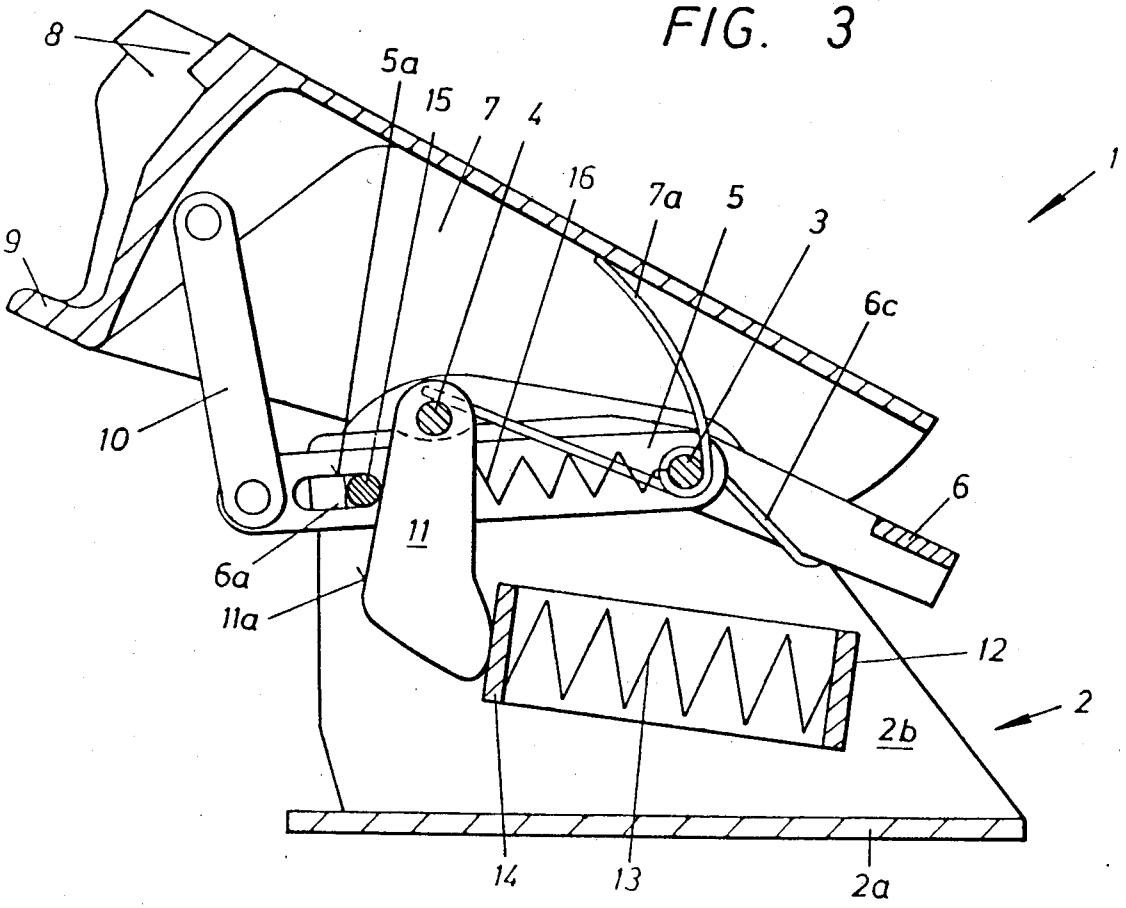
FIG. 3 is a sectional side view similar to FIG. 1 but showing the heel holder in its stepping-in position.

The heel holder which is illustrated in FIGS. 1–3 is identified in its entirety with reference numeral 1. It has a bearing block 2 which is approximately U-shaped in cross section and which has a base 2*a*. In a conventional manner, the base 2*a* is longitudinally movably supported on and can be fixedly secured at selected locations along two conventional and not illustrated guide rails provided on an upper side of a not illustrated ski. Two axles 3 and 4 extend between and are supported on two spaced sidewalls 2*b* of the bearing block 2. The axle 3 pivotally supports two joint plates 5, a release lever 6 which in the top view if approximately U-shaped, and a binding housing 7 which at its front end which faces the ski shoe has a down-holding member 8 and a stepping spur 9. The binding housing 7 is pivotally connected to two further joint plates 10 which are in turn pivotally connected to the joint plates 5. At least one torsion spring 7*a*, which acts as an opening spring for the housing 7, is also supported on the axle 3.

A control lever 11 is pivotally supported on the axle 4. Furthermore, a spring housing 12, which is U-shaped in the top view and which supports a locking spring 13, is secured to and located between the two sidewalls 2*b* of the bearing block 2. The locking spring 13 can be adjusted in its initial tension in a conventional manner which is not illustrated in the drawings. The locking spring 13 biases the control lever 11 through a spring washer or slide member 14 which is longitudinally movably supported in the spring housing 12 and which is guided for such movement in a conventional manner by not illustrated slots in the legs of the spring housing 12. The two joint plates 5 have slots 5*a* through which a pin or bolt 15 extends. The bolt 15 is biased by two tension or expansion springs 16, which urge it toward the axle 3. Through this, the bolt or control member 15 slidably engages at all times a control surface 11*a* on the control lever 11. The release lever 6 is constructed with two arms and is slightly bent in the region of the axle 3. The release lever 6 carries a hook-shaped projection 6*a* on one arm and the projection 6*a*, in the skiing position of the heel holder 1, holds the bolt 15.

The heel holder 1 is in its downhill skiing position in FIG. 1. When the heel holder undergoes an automatic release, for example when the skier falls, the bolt 15 slides along the control surface 11*a* of the control lever 11. The washer 14 is thereby pressed rightwardly in FIG. 1 against the force of the locking spring 13, and the spring 13 is compressed. As soon as the release point is exceeded, the torsion spring 7*a* on the axle 3 swings the binding housing 7 clockwise into its stepping-in position (shown in FIG. 3). This swinging movement is also due in part to the urging of the locking spring 13.

When the heel holder 1 is to be voluntarily released, the release lever 6 is manually swung clockwise against the force of the spring 6*c*. The projection 6*a* on each leg of the release lever 6 is thereby disengaged from the bolt 15, and the bolt 15 can then be moved leftwardly toward the ski shoe in the two slotted holes 5*a* against the urging of the two springs 16 by the surface 11*a* as the housing 7 pivots upwardly. Since the two springs 16 are relatively weak, only a relatively small force is needed to pivot the heel holder 1 into its open position, which force is produced by the torsion spring 7*a* which sits on the axle 3. As soon as the open position is reached, the release lever 6 can be swung counterclockwise by the torsion spring 6*c*, so that the projection 6*a* again grips the bolt 15 (see FIG. 3). The skier can then step with his ski shoe into the heel holder 1 again.

A further embodiment is illustrated in FIGS. 4–7. This heel holder 1' also has a bearing block 2 which is approximately U-shaped in cross section and which has a base 2*a* which is movable on and fixable with respect to two not illustrated guide rails provided on the upper side of a not illustrated ski. Two axles 3 and 4 are supported on two sidewalls 2*b* of the bearing block 2. The axle 3 pivotally supports two joint plates 5, a release lever 6' which is approximately U-shaped in the top view, and a binding housing 7 which at its front end which faces the ski shoe has a down-holding member 8 and a stepping spur 9. The binding housing 7 is connected by two further joint plates 10 to the joint plates 5. Furthermore, at least one torsion spring 7*a* which acts as an opening spring is supported on the axle 3.

A control lever 11 is pivotally supported on the other axle 4. Furthermore, a spring housing 12, which in the top view is U-shaped, is secured between the two sidewalls 2*b* of the bearing block 2, in which spring housing 12 is supported a locking spring 13 which can have its initial tension adjusted in a conventional and not illustrated manner. The locking spring 13 biases the lever 11 through a spring washer 14 which is longitudinally movably supported in the spring housing 12 and which is guided in a conventional manner by not illustrated slots in the legs of the spring housing 12. The two joint plates 5 have slots 5*a* through which a bolt 15 extends, the bolt 15 being biased by two expansion springs 16 which urge it toward the axle 3. Through this, the bolt 15 slidably engages at all times a control surface 11*a* on the control lever 11. The release lever 6' is constructed with two arms and is slightly bent in the region of the axle 3. The release lever 6' carries on one arm a hook-shaped projection 6'*a* which holds the bolt 15 in the downhill skiing position of the heel holder 1.

The hook-shaped projection 6'*a* has a flat surface 6'*d* thereon which, in the downhill skiing position of the heel holder 1', extends perpendicular to the slots 5*a* of the two joint plates 5. This surface 6'*d* is followed by a slot or guideway 6'*b* which is in the hook, which is inclined with respect to the axis of the slots 5*a*, and which is open at one end, in which guideway 6'*b* the bolt 15 can slide until it reaches the inner end of the guideway when the skier steps with his ski shoe into the heel holder 1'. This facilitates a reduced stepping-in force, as described later. The release lever 6' is biased by a torsion spring 6'*c* which urges it counterclockwise, the other end of the spring 6'*c* being anchored on one of the joint plates 5.

A two-arm auxiliary lever 16*b* is pivotally supported on an axle 17 on the binding housing 7 at the end thereof opposite the down-holding member 8. This lever 16*b* is biased by a torsion spring 16*a* which urges the auxiliary lever 16*b* counterclockwise. The other end of the torsion spring 16*a* rests on a pin or bolt 18 which is provided on and extends transversely of the release lever 6'. The bolt 18 is used to releasably secure the release lever 6', by means of the auxiliary lever 16*b*, against movement with respect to the binding housing 7. Reference numeral 19 (FIG. 5) identifies a stop which is provided on the binding housing 7 and limits the angle of pivoting of the auxiliary lever 16*b* in a counterclockwise direction.

When the heel holder undergoes an automatic release, the bolt 15 remains in engagement with the surface 6'*d* of the lever 6' and slides along the control surface 11*a* of the control lever 11. The spring washer 14 is thereby pressed rightwardly against the force of the locking spring 13, and the spring 13 is tensioned. As soon as the release point is passed, the torsion spring 7*a*, which is supported on the axle 3, swings the binding housing 7 into its stepping-in position (see FIG. 4). This swinging movement is assisted in part by the urging of the locking spring 13.

Figure 7:
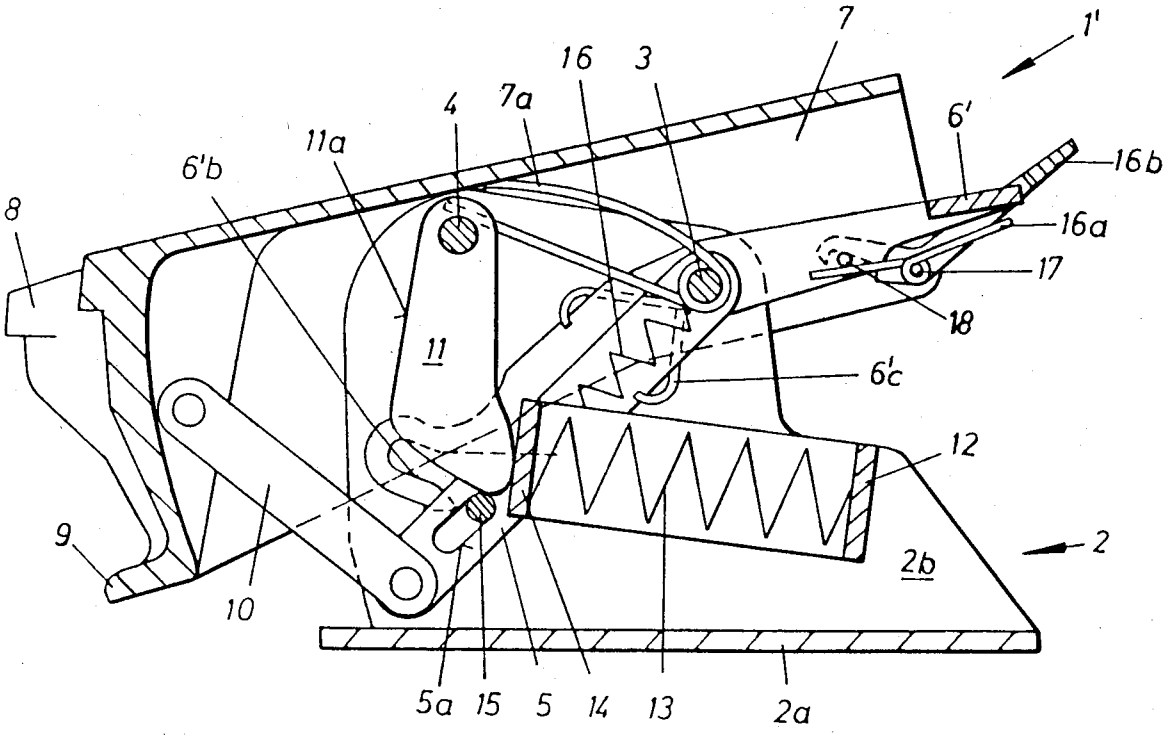
FIG. 7 is a view similar to FIG. 4 showing the heel holder in the downhill skiing position and directly prior to a voluntary release.

When the heel holder 1' is to be released voluntarily, the release lever 6' is swung clockwise against the force of the spring 6'*c* (FIG. 7). The surface 6'*d* is moved away from the bolt 15 at each leg of the release lever 6', which bolt 15 can now be moved toward the ski shoe in the two slots 5*a* against the force of the two springs 16. Since the two springs 16 are relatively weak, only a relatively small force for swinging the heel holder 1' into its open position is required from the torsion spring 7*a*.

During the swinging movement of the binding housing 7 in the clockwise direction, the bolt 18 on the release lever 6', which in the downhill skiing position of the heel holder 1' was moved away from the hook-shaped end of the auxiliary lever 16*b* (see FIG. 7), moves back toward this end, and will ultimately engage the hook-shaped end and prevent further swinging of the release lever. As soon as the bolt 15, under the urging of the two springs 16, has again reached the rightmost end of the slot 5*a* in each joint plate 5, the release lever 6' snaps in a counterclockwise direction back into the position in which the surface 6'*d* engages the bolt 15 and holds it against movement within the two slots 5*a*. The skier can then step with his ski shoe into the heel holder 1' again.

Figure 4:
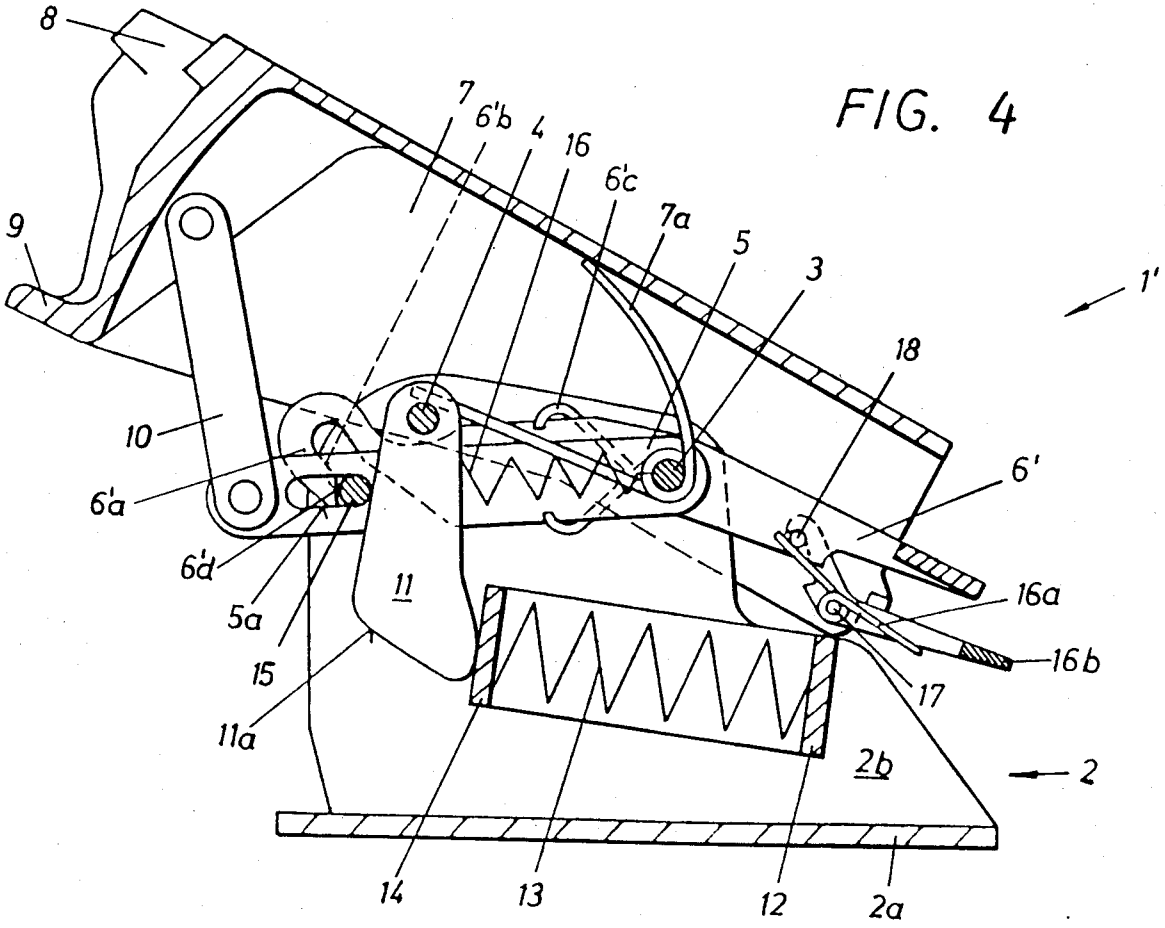
FIG. 4 is a sectional side view of an alternative embodiment of the heel holder of FIG. 1 in its stepping-in position.
Figure 5:
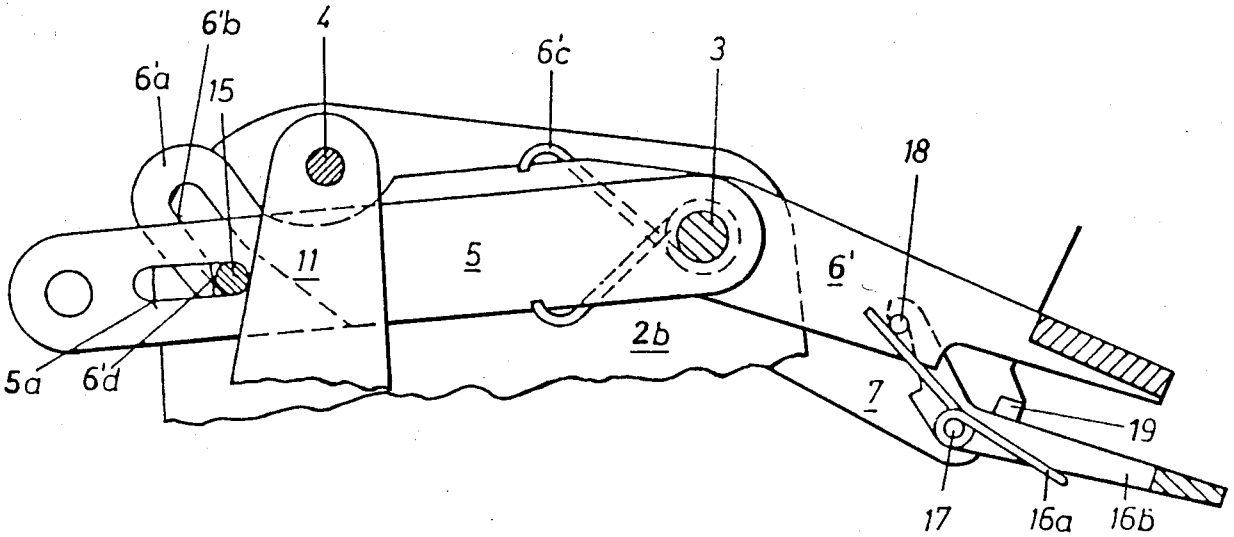
FIG. 5 is a view of a portion of the structure of FIG. 4 in an enlarged scale and in a different operational position.
Figure 6:
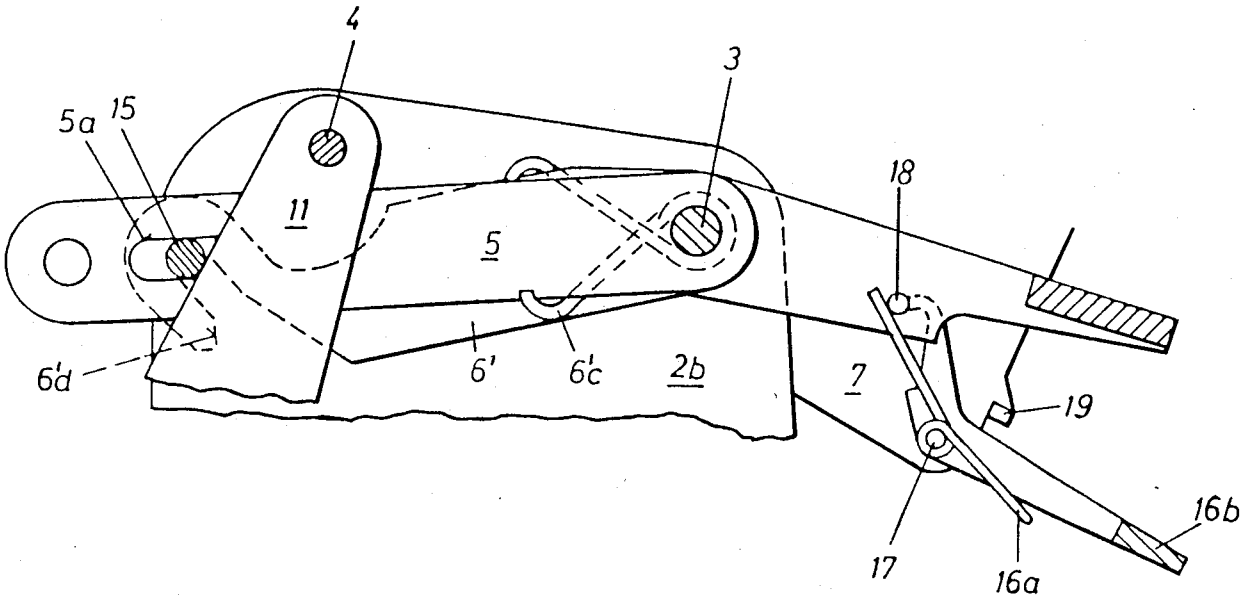

When, in the stepping-in position which is illustrated in FIG. 4, the down-holding member 8 is stepped down, it would require significant effort by the skier if the full force of the locking spring 13 had to be overcome. To avoid this, the auxiliary lever 16*b* can be swung clockwise by the skier against the force of the torsion spring 16*a*. The auxiliary lever 16*b* thereby releases the bolt 18 on the release lever 6', and the release lever 6' can then swing counterclockwise under the urging of the torsion spring 6'*c*. Through this, the bolt 15 moves into the guideways 6'*b*, the effective lengths of which are slightly shorter than the lengths of the two slots 5*a* in the joint plates 5. During stepping down of the down-holding member 8 by the ski shoe of the skier, the locking spring 13 is slightly compressed, but the movement of the spring washer 14 which is needed for stepping in is substantially reduced with respect to its movement during a normal stepping in, so that the effort required during stepping in is substantially reduced.

Figure 8:
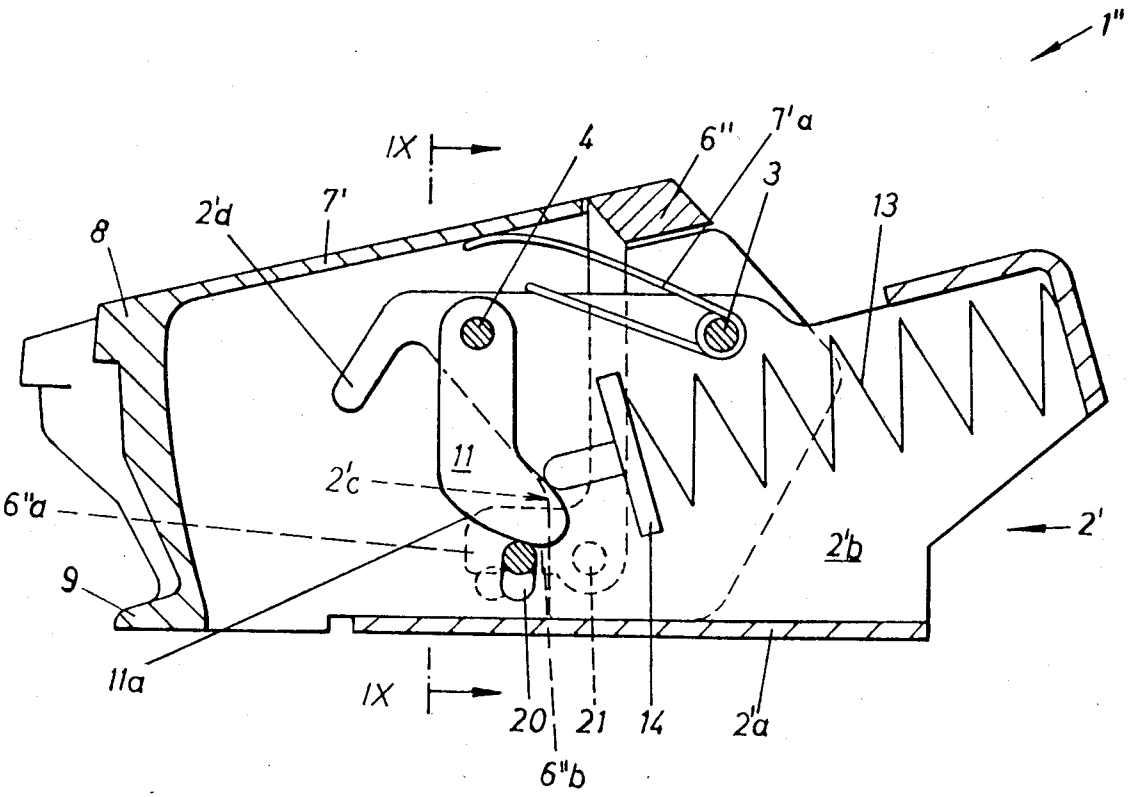
FIG. 8 is a sectional side view of a third exemplary embodiment of the inventive heel holder and is taken along the line VIII—VIII in FIG. 9.
Figure 9:
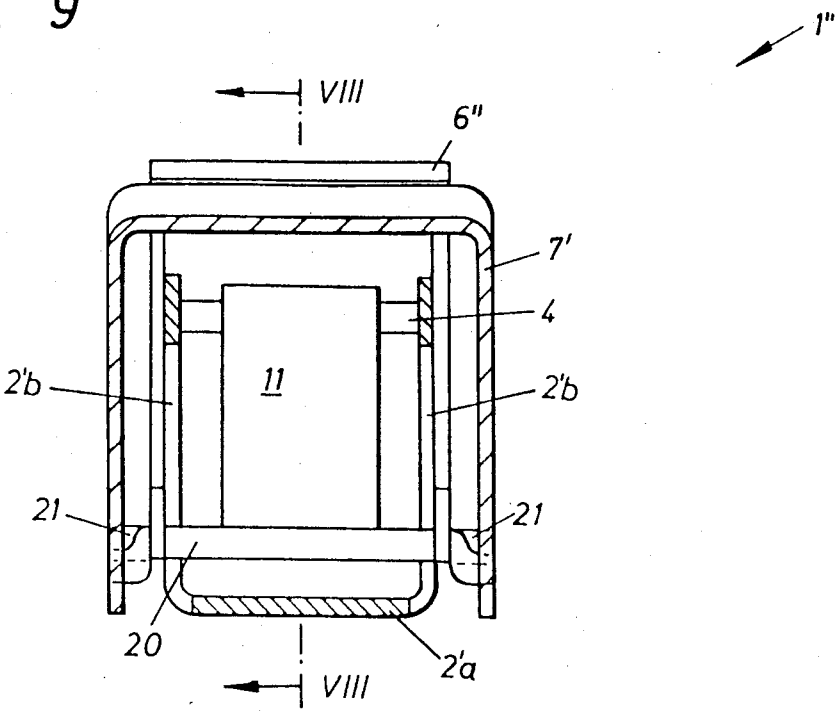
FIG. 9 is a sectional view taken along the line IX—IX in FIG. 8.

A slightly modified exemplary embodiment is illustrated in FIGS. 8 and 9. The heel holder 1'' which is illustrated in these figures has a bearing block 2' which is approximately U-shaped in cross section and has a base 2'*a* and two sidewalls 2'*b*. The two sidewalls 2'*b* have at their ends which face the ski shoe shoulders 2'*d* which extend from the upper side of the bearing block 2' downwardly and forwardly at an incline. Two axles 3 and 4 extend between and are supported by the two sidewalls 2'b. The axle 3 pivotally supports a binding housing 7' which carries on its side facing the ski shoe a downholding member 8 and a stepping spur 9. A torsion spring 7'a, which is an opening spring, is arranged on the axle 3, and a control lever 11 is supported pivotally on the axle 4. Furthermore, the bearing block 2' supports a locking spring 13 which, through a spring washer 14 which is movable longitudinally of the spring, biases the side of the control lever 11 which does not face the ski shoe. The spring washer 14, in a conventional manner, has not illustrated lateral shoulders which are guided movably in not illustrated slots in the sidewalls 2'b of the bearing block 2'. Of course, the locking spring 13 is also adjustable in its initial tension in a conventional manner.

A crankshaft 20 is provided below the control lever 11, has a crank which engages the control lever 11, and has its two ends pivotally supported in the sidewalls of the binding housing 7'. The two sidewalls 2'b of the bearing block 2 each have in the region of the crankshaft 20 a recess 2'c which permits a 90° rotation of the crankshaft. Furthermore, a release lever 6'' which is U-shaped in a front view and is a toggle lever is supported pivotally by two axially spaced, coaxial axle parts 21 on the binding housing 7'. One arm of the release lever 6'' carries a hook-shaped projection 6''a, which can hold the crankshaft 20 in a position in which the crankshaft crank engages the control surface 11a.

In the downhill skiing position, the heel holder 1'' is in the position illustrated in FIG. 8. When, during skiing, an automatic release of the heel holder 1'' takes place, the binding housing 7' is pivoted clockwise about the axle 3. The control lever 11 is thereby swung counterclockwise, and the locking spring 13 is compressed. After the crank of the crankshaft 20 has passed the release point on the control lever 11, the binding housing 7' is swung by the torsion spring 7'a into the stepping-in position. The release lever 6'', which is here supported between the bearing block 2 and the binding housing, participates in this swinging movement.

Alternatively, when a voluntary release of the heel holder 1'' is to be started, the release lever 6'' is manually swung clockwise through a pregiven angle. Through this, the hook-shaped projection 6''a of the release lever 6'' releases the crank of the crankshaft 20. The crankshaft 20 is now pivoted 90° counterclockwise by the control lever 11 due to the urging of the locking spring 13. This movement of the crankshaft 20 is also effected in part by a surface 6''b of the release lever 6'', which surface lies opposite the projection 6''a. Through this, the crankshaft 20 no longer contacts the control lever 11, and the binding housing 7', under the influence of the torsion spring 7'a, swings into the stepping-in position. However, before the stepping-in position is reached, the crank of the crankshaft 20 engages the two shoulders 2'd on the sidewalls 2'b of the bearing block 2'. This contact causes the crankshaft 20 to be pivoted 90° in a clockwise direction to its original position. In this position of the crankshaft 20, it is possible to swing the release lever 6'' counterclockwise and back into its original position, in which its hook-shaped projection 6''a holds the crank of the crankshaft 20. The skier can now step into the heel holder 1'' and swing the housing into its downhill skiing position.

Of course, the invention is by no means limited to the exemplary embodiments which are illustrated in the drawings and described above. Rather, various variations and modifications, including the rearrangement of parts, are possible without leaving the scope of the invention. For example, the locking spring in the last exemplary embodiment does not need to be supported directly on the bearing block, but could be provided in a spring housing which is U-shaped in the top view, which is fixed rigidly on the bearing block, and which carries the slots for guiding the movable spring washer which engages the control lever.

The embodiments of the invention in which an exclusive property or privilege is claimed are defined as follows:

1. A heel holder, comprising: a bearing block; a binding housing which is pivotally supported by a first transverse axle on the bearing block, which is biased from a downhill skiing position toward a released position by an opening spring, and which carries at an end thereof which faces a ski shoe releasably held by the heel holder a down-holding means and a stepping spur; a control lever which is pivotally supported by a second transverse axle on the bearing block and which is biased by a locking spring, said first and second transverse axles being spaced from one another in the longitudinal direction of the ski; and a control member disposed on a side of the control lever remote from the locking spring and the first transverse axle, and means supporting the control member for reciprocal movement along an approximately arcuate path generally concentric to the first axle synchronously with and in response to pivotal movement of the binding housing and for movement toward and away from the first axle between first and second positions, movement of the control member from its second to its first position being movement thereof toward the first axle, and the member being engageable with a surface on the control lever; a release lever pivotally supported on the bearing block on the first axle for movement between a locking position and a release position, the release lever having two legs which each carry a hook-shaped projection and which are arranged within sidewalls of the bearing block and on opposite sides of the control lever, each said hook-shaped projection being engageable with the control member when the release lever is in its locking position so as to prevent movement of the control member away from its first position toward its second position, and being free of engagement with the control member when the release lever is in its release position; and a respective expansion spring arranged adjacent each leg of the release lever, one end of each said expansion spring being coupled to the first axle and the other end being coupled to the control member, the expansion springs yieldably urging movement of the control member from its second toward its first position.

2. A heel holder, comprising: a bearing block; a binding housing which is pivotally supported by a first transverse axle on the bearing block, which is biased from a downhill skiing position toward a released position by an opening spring, and which carries at an end thereof which faces a ski shoe releasably held by the heel holder a down-holding means and a stepping spur; a control lever which is pivotally supported by a second transverse axle on the bearing block and which is biased by a locking spring, said first and second transverse axles being spaced from one another in the longitudinal direction of the ski; and a control member which is engageable with a side of the control lever which faces the ski shoe, the control member being releasably held by a release lever in a downhill skiing position of the heel holder; wherein the release lever is supported on the bearing block on the first axle, and has two legs which carry hook-shaped projections and are arranged within sidewalls of the bearing block; wherein a respective expansion spring is arranged adjacent each leg of the release lever, one end of each expansion spring being coupled to the first axle and the other end being coupled to the control member; wherein the control member is guided in slots provided in two first joint plates, one end of each said first joint plate being supported on the first axle and the other end thereof being connected by a respective second joint plate to the binding housing.

3. A heel holder, comprising: a bearing block; a binding housing which is pivotally supported by a first transverse axle on the bearing block, which is biased from a downhill skiing position toward a released position by an opening spring, and which carries at an end thereof which faces a ski shoe releasably held by the heel holder a down-holding means and a stepping spur; a control lever which is pivotally supported by a second transverse axle on the bearing block and which is biased by a locking spring, said first and second transverse axles being spaced from one another in the longitudinal direction of the ski; and a control member which is engageable with a side of the control lever which faces the ski shoe, the control member being releasably held by a release lever in a downhill skiing position of the heel holder; wherein the release lever is supported on the bearing block on the first axle, and has two legs which carry hook-shaped projections and are arranged within sidewalls of the bearing block; wherein the release lever can be positioned in three different angular positions with respect to the binding housing; including spaced elements supported on said bearing block and each having therein a slot which slidably receives the control member; and wherein on the release lever, adjacent to surfaces which can engage the control member and extend perpendicular to the longitudinal axes of the slots, there are guideways which are inclined with respect to the longitudinal axes of the slots and permit, during swinging of the release lever relative to the binding housing, shifting of the control member through a pregiven portion of the path of movement defined by the slots.

4. The heel holder according to claim 3, wherein the release lever is under the influence of a torsion spring which urges it toward a locking position thereof, and wherein for locking the release lever in a downhill skiing position, at least one lock member is supported on the binding housing and engageable with the release lever.

5. The heel holder according to claim 4, wherein the lock member is a two-arm auxiliary lever which is biased by further torsion spring and which has an end which is hook-shaped and, in the downhill skiing position, grips over a bolt provided on the release lever.

6. The heel holder according to claim 5, wherein the bolt extends in a transverse direction and supports one leg of the further torsion spring.

7. The heel holder according to claim 5, including a stop arranged on the binding housing to limit, after a release of the auxiliary lever, the angle of movement of the auxiliary lever.

* * * * *